US008898823B2

(12) United States Patent
McHugh, III

(10) Patent No.: US 8,898,823 B2
(45) Date of Patent: Dec. 2, 2014

(54) TEMPLATE FOR CLOSET FLANGE

(76) Inventor: John Joseph McHugh, III, Chelmsford, MA (US)

( * ) Notice: Subject to any disclaimer, the term of this patent is extended or adjusted under 35 U.S.C. 154(b) by 249 days.

(21) Appl. No.: 13/341,107

(22) Filed: Dec. 30, 2011

(65) Prior Publication Data

US 2013/0167292 A1 Jul. 4, 2013

(51) Int. Cl.
*E03D 11/16* (2006.01)
*E03D 11/14* (2006.01)

(52) U.S. Cl.
USPC ..... 4/252.4; 4/252.1

(58) Field of Classification Search
CPC ..... E03D 11/16
USPC ..... 4/252.1–252.6
See application file for complete search history.

(56) References Cited

U.S. PATENT DOCUMENTS

| | | | | |
|---|---|---|---|---|
| 2,638,379 | A * | 5/1953 | Spring | 296/145 |
| 6,443,495 | B1 * | 9/2002 | Harmeling | 285/56 |
| 6,725,468 | B2 * | 4/2004 | Molina | 4/252.1 |
| 8,443,844 | B2 * | 5/2013 | Zeyfang | 138/96 R |
| 2003/0126676 | A1 * | 7/2003 | Gallacher et al. | 4/252.5 |
| 2012/0240319 | A1 * | 9/2012 | Yssel | 4/252.1 |

* cited by examiner

*Primary Examiner* — Huyen Le
*Assistant Examiner* — Christine Skubinna
(74) *Attorney, Agent, or Firm* — K&L Gates LLP

(57) ABSTRACT

Provided are templates, methods, and kits for installing closet flanges. The template can include a body having a sidewall and a bottom as well as a plurality of tabs connected to the body, with one or more of the tabs configured to delineate the location of a fastener hole in a closet flange.

15 Claims, 12 Drawing Sheets

TEMPLATE FOR CLOSET FLANGE

BACKGROUND

Toilet installation typically requires installing a closet flange on a finished floor and securing the toilet to the closet flange. The closet flange anchors the toilet to the floor and also seals the toilet to the closet drain pipe to prevent water leakage. The closet flange often is secured to the subfloor and/or underlayment. The position and number of closet flange fasteners (e.g., screws, bolts, and nails) is dependent on the type of closet flange being installed (e.g., Oatley, Charlotte, etc.), which in turn may be dependent on the toilet being installed. However, the flooring contractor may not know the type of closet flange the plumber will install. Consequently, when the plumber returns to install the closet flange, the closet flange fasteners may not align properly with the floor installed by the flooring contractor and/or the floor may be too close to the drain pipe. If the floor has been tiled, the plumber may chip, crack or otherwise damage the tiles when attempting to fix the alignment. As a result, the tiler may need to be recalled to fix the damage before the plumber can install the closet flange and toilet, which results in construction delays and wasted materials.

SUMMARY

The invention provides, in part, templates for closet flange installation. These templates can include a body having a sidewall and a bottom, the sidewall having a height and terminating in an edge, and a plurality of tabs connected to the edge, with one or more of the tabs configured to delineate the location of a fastener hole in a closet flange. The closet flange can have a plurality of fastener holes for securing the closet flange to a floor and at least one slot for engaging a toilet hold-down bolt.

Embodiments of the template can include one or more of the following features.

Each of the plurality of tabs can protrude from the edge of the sidewall and can be substantially in-line with the sidewall.

The body can be any suitable shape, and preferably is substantially circular. In addition, the body can be substantially bowl shaped.

The body can have a diameter that is approximately the same size as the outside diameter of a closet drain pipe.

The bottom of the template can form or define a hole for attaching the template to a test plug having a bolt.

The template can be integral with a test plug.

The body of the template can include a marker that delineates the center line of the template, to assist in orienting the template.

At least one tab of the template can form a hole sized to received a drill bit.

At least one tab of the template can be movable between a position substantially in-line with the sidewall to a substantially horizontal position.

Templates can include a crease between at least one tab and the body to facilitate tab folding.

The outside surface of the template sidewall can include height graduations.

One or more of the plurality of tabs can be reinforced with a deformable material.

The body and/or tabs of the template can be composed of plastic.

In part, the invention also provides methods of installing a closet flange, which typically have a plurality of fastener holes for securing the closet flange to a floor and at least one slot for engaging a toilet hold-down bolt. The method can include the steps of orienting a template, the template being placed over the open end of a closet drain pipe; dry-fitting flooring around the closet drain pipe; marking the flooring at the location of fastener holes in a closet flange using the tabs; notching the flooring; and installing the flooring around the drain pipe.

In part, the invention further provides template kits. The kits can include a closet flange template, as well as a test plug and/or a closet flange.

BRIEF DESCRIPTION OF DRAWINGS

The figures are not necessarily to scale, emphasis instead generally being placed upon illustrative principles. The figures are to be considered illustrative in all aspects and are not intended to limit the invention, the scope of which is defined only by the claims.

FIG. 6A is a top plan view, FIG. 6B is a top plan view, FIG. 6C is a top plan view and FIG. 6D is a top perspective view.

DETAILED DESCRIPTION

The invention relates in part to templates that facilitate installation of closet flanges, bridging the gap between rough plumbing and finish flooring. During construction or remodeling, a plumber initially rough plumbs a bathroom, for example, by installing drainage pipes where the toilet, sink and/or shower eventually will be installed. After installing the rough plumbing, the drainage pipes are plugged while other contractors install flooring, wire electricity, install insulation, install drywall, etc. Drainage pipes are plugged, in part, for building code inspection and also to prevent debris from falling in. After the bathroom floor has been installed, the plumber returns to finish the plumbing, such as by installing a closet flange and a toilet.

Figure 1:
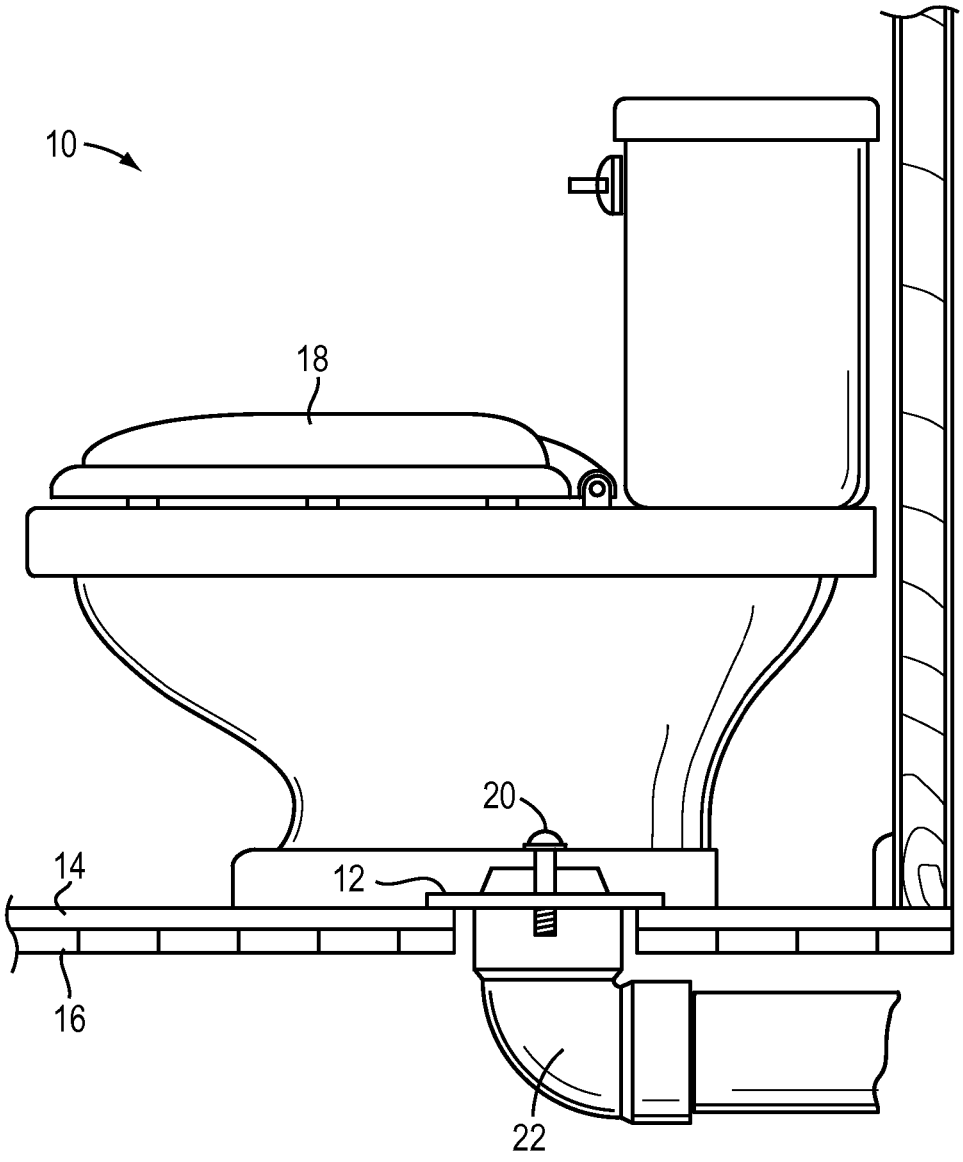
FIG. 1 shows a standard toilet installation.

FIG. 1 shows a standard toilet installation 10. A closet flange 12 sits on the finished floor 14. The closet flange 12 is secured to the subfloor 16 using screws or any other suitable fasteners, such as nails, bolts, etc. The toilet 18 then is bolted 20 to the closet flange 12 to anchor the toilet 18 to the floor 14 and/or subfloor 16. A wax ring sits on the closet flange and provides a watertight seal between the toilet 18 and the drain pipe 22, which carries away waste water.

Figure 2:
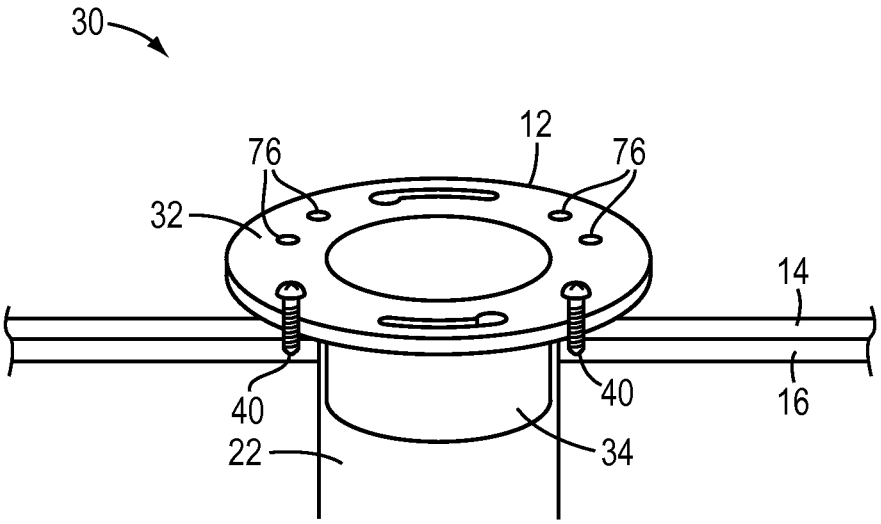
FIG. 2 shows a standard closet flange installed in a drain pipe.

FIG. 2 shows a standard closet flange installation 30. The flange 32 of the closet flange 12 sits on the finished floor 14. The finished floor 14 rests on a subfloor 16, which typically is plywood or wood slats. For some installations, an underlayment, such as cement board or radiant heating, may be installed between the subfloor 16 and the finished floor 14. The closet flange 12 also contains a hub 34 that engages the inside (or, in some configurations, the outside) of the drain pipe 22. The hub 34 is sealed to the drain pipe 22 to prevent water leakage, and the flange 32 is secured to the subfloor 16 using fasteners 40, such as screws, nails, bolts, etc.

Bathrooms frequently are tiled, which presents additional challenges for toilet installation. Tiles are relatively difficult to shape and manipulate without specialized tools and training. In addition, a tile contractor must leave an appropriately sized hole in the finished tile floor to accommodate the drain pipe 22 and/or the hub 34 of the closet flange 12 while being snug enough so that the flange 32 of the closet flange 12 rests on the finished floor 14 rather than on the subfloor or underlayment 16. The tiles also must be notched, cut or drilled at the location of each closet flange fastener (e.g., screw) so that the fasteners can penetrate into the subfloor and/or underlayment.

The plumber often knows in advance the type of closet flange that will be installed. However, because closet flanges 12 can be relatively expensive, and it can be several weeks or months before the plumber returns to install the toilet, the plumber may not want to leave uninstalled closet flanges at the job site because the closet flanges may be lost, damaged, discarded, or stolen. In addition, dry-fitting a closet flange 12 in the drain pipe 22 for purposes of marking and installing the finished floor 14 can result in inaccuracies and misalignment. Thus, in accordance with one embodiment, after installing the rough plumbing, the plumber may install the appropriate closet flange template 40 for use by, for example, a tile contractor, who typically has the experience and tools for cutting and drilling tile. The template 40 can be configured to removably attach to a drain plug 52, such as a test plug, that is inserted in the drain pipe 22 after the rough plumbing is completed.

Figure 3:
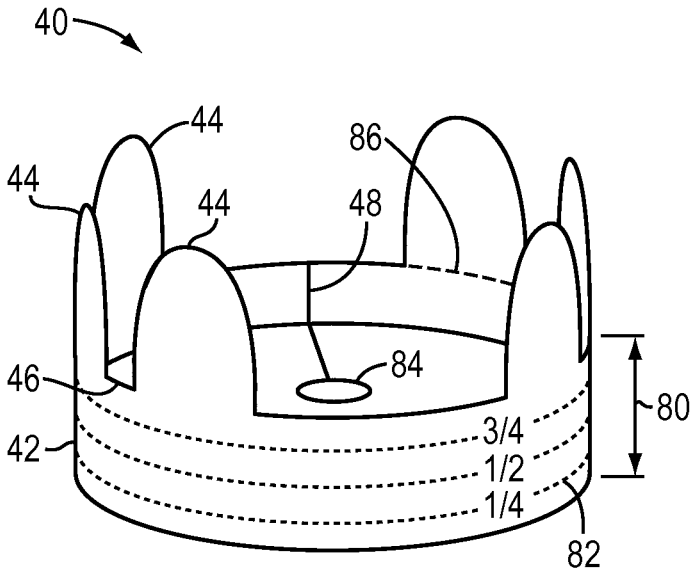
FIG. 3 is a schematic of a closet flange template, in accordance with an illustrative embodiment.

FIG. 3 is a schematic of a closet flange template 40, in accordance with an illustrative embodiment. The template has a three dimensional, bowl-shaped body 42 that includes a plurality of tabs 44 connected to the edge or rim 46 of the bowl. The tabs 44 also can be attached to or protrude from the sidewall of the bowl, and can be integral with or attached to the body 42 of the bowl. In various embodiments, the template 40 is substantially circular or round; however, other shapes can be used. A circular profile is helpful for aligning the template and installing the finished floor 14 because typically both the drain pipe 22 and the closet flange 12 also are round. The tabs 44 mark the positions of the fastener holes 76 in the flange 32 of the closet flange 12 and assist the flooring contractor in locating and cutting notches or holes in the floor to accommodate the fasteners (e.g., screws) that secure the closet flange 12 to the floor. In addition, the template 40 can include a marker 48, such as a line, that aids in rotationally orienting the template 40 and for measuring the rough in distance of the drain pipe 22 from a wall or other bathroom structure.

Figure 4:
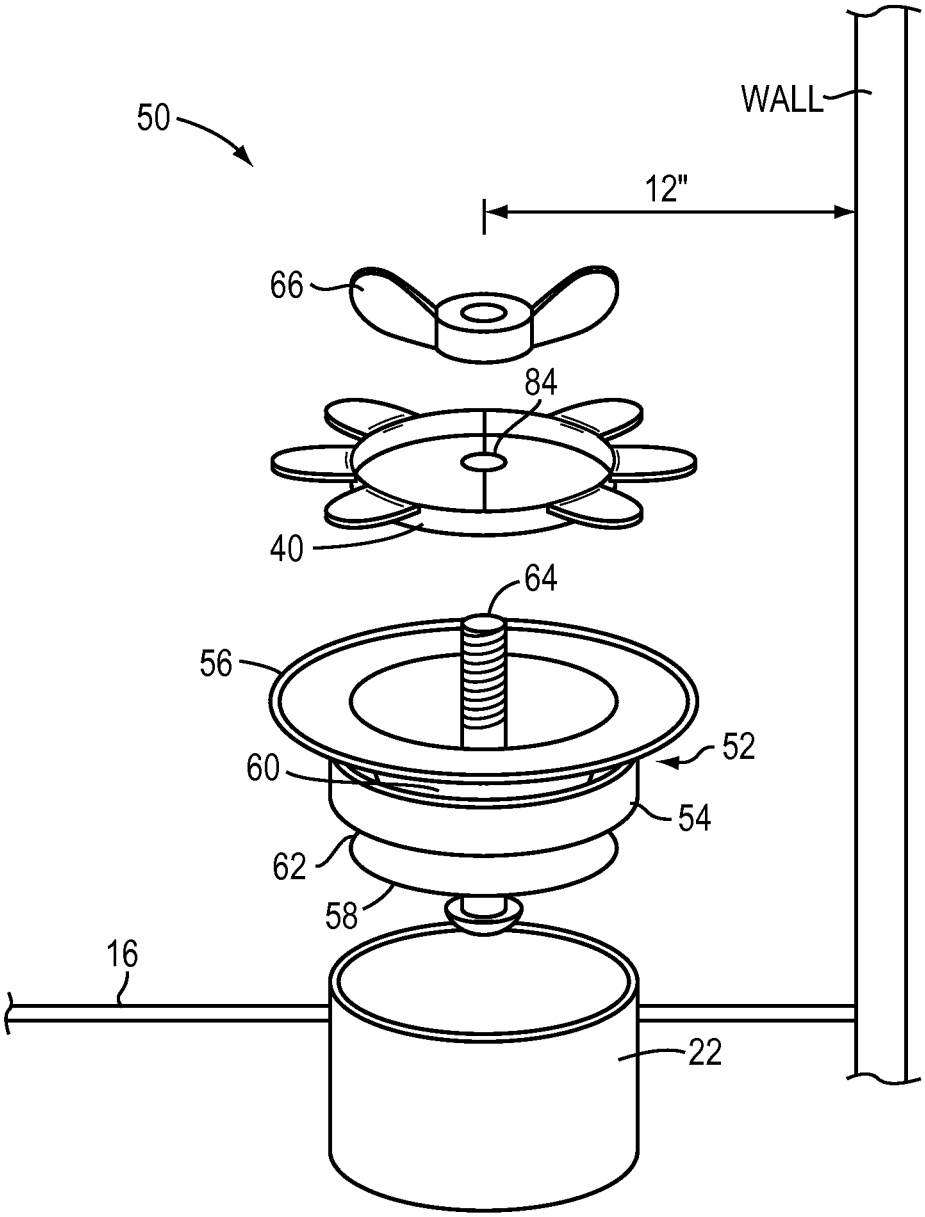
FIG. 4 is a schematic of a closet flange template assembly, in accordance with an illustrative embodiment.

FIG. 4 is a schematic of a closet flange template assembly, in accordance with an illustrative embodiment. The assembly 50 includes a template 40 and a test plug 52. Test plugs are well known in the art (see, e.g., U.S. Pat. No. 4,493,344) and can include an o-ring 54 sandwiched between top 56 and bottom plates 58 having inwardly tapering shoulders 60, 62. The plates 56, 58 are connected by a bolt 64 and a nut 66. As the nut 66 is tightened, the plates 56, 58 squeeze the o-ring 54 which causes it to expand diametrically, thereby allowing it to seal the end of the drain pipe 22. Test plugs 52 are used during construction to plug the drain pipe 22 for pressure testing of the plumbing, for preventing debris from falling into the drain pipe 22 while other contractors work in the area, and for stopping sewer gas from backing into the bathroom. The closet flange template 40 can have a hole 84 on center for securing the template 40 to the test plug 52 by inserting the template 40 on the bolt 64 of the test plug 52. Nut 66 is treaded onto the bolt 64 to capture the template 40 on the bolt 64. The template/test plug assembly 50 is then inserted into the end of the drain pipe 22 and the test plug 52 tightened using the nut 66 until it seals the drain pipe 22. Closet flange templates 40 can be sold as a kit with a test plug 52 and/or a closet flange 12, or the items can be sold separately. In some embodiments, the template 40 is integral with the test plug 52.

Figure 5A:
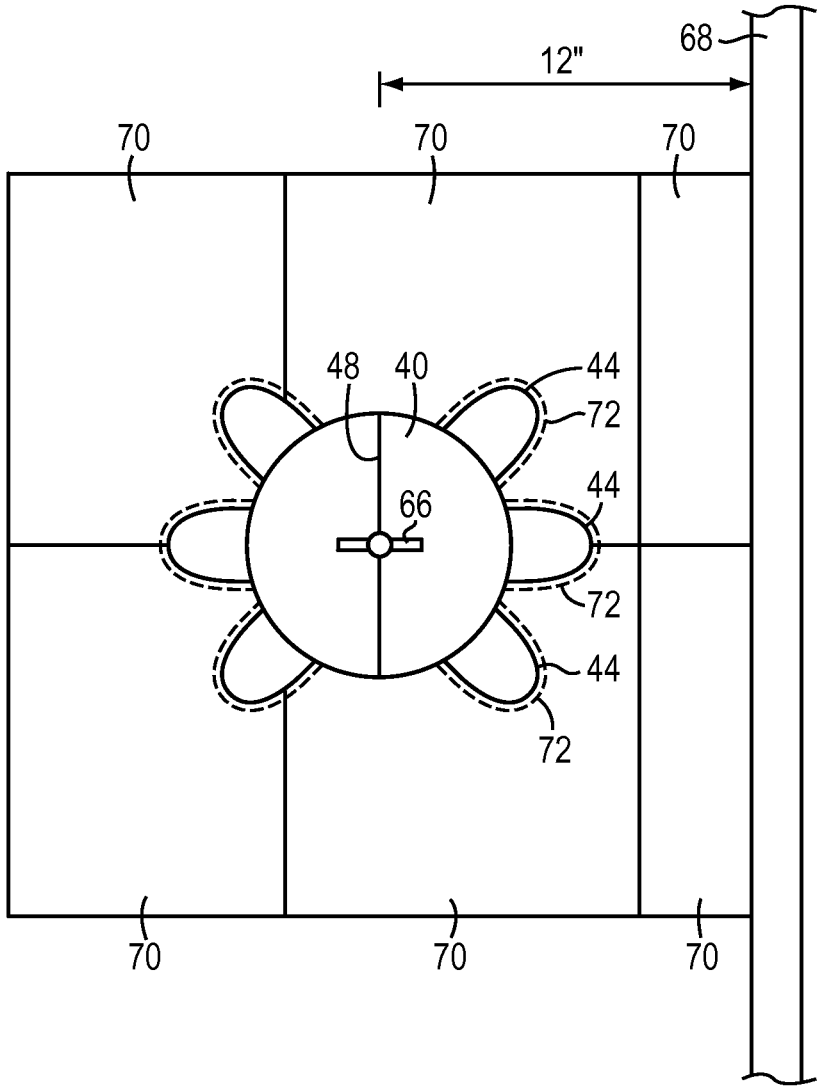
FIG. 5A is a top view of a closet flange template secured in a drain pipe, in accordance with an illustrative embodiment.

FIG. 5A is a top view of a template/test plug assembly 50 secured in a drain pipe, in accordance with an illustrative embodiment. After the template/test plug assembly 50 has been tightened in the drain pipe 22, the template 40 is rotated until the marker line 48 is substantially parallel to the wall or other bathroom structure 68 so that the closet flange 12, and therefore the toilet 18, will be properly aligned. The marker 48 can also assist the plumber in positioning the drain pipe 22 at the appropriate distance from the wall. The plumber then leaves the template/test plate assembly 50 for later use by the flooring contractor. When the flooring contractor is ready to install the floor around the drain pipe 22, the floor contractor confirms that the template 40 is properly aligned using the marker line 48, and then dry-fits the floor (e.g., tiles 70) around the drain pipe 22. The floor contractor uses the tabs 44 on the template 40 to mark the floor 72 at the location of each fastener hole 76 in the closet flange 12 before notching the floor. In the case of a tile floor, the tiles can be notched with a wet saw or grinder, for example. The notched flooring would then be installed around the drain pipe 22.

Figure 5B:
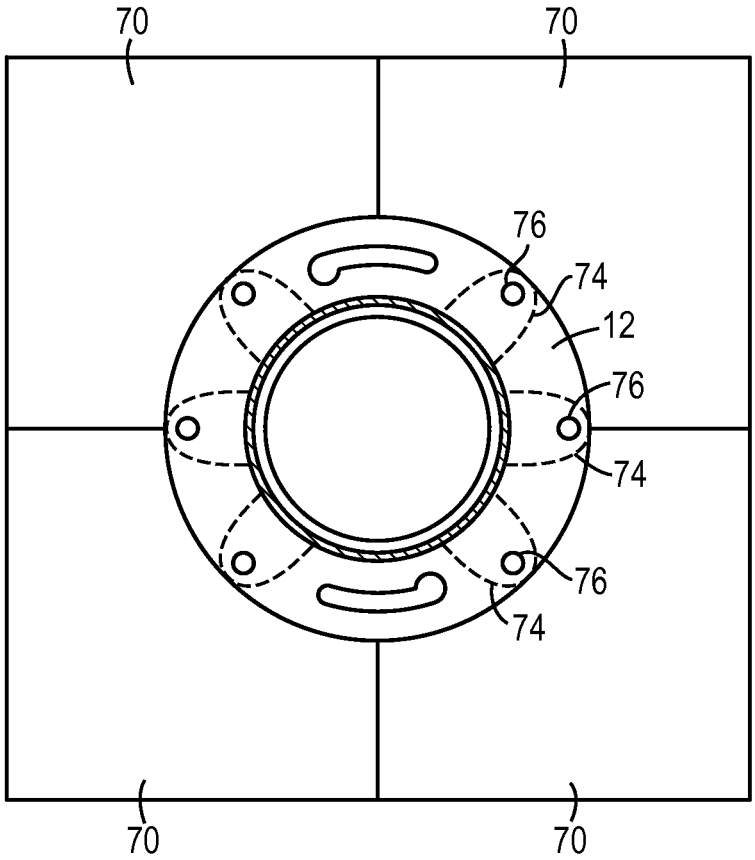
FIG. 5B is a top view of a closet flange (shown in dashed lines) installed in a drain pipe, in accordance with an illustrative embodiment.

FIG. 5B is a top view of a closet flange 12 (shown in dashed lines) installed in a drain pipe 22, in accordance with an illustrative embodiment. As is shown in FIG. 5B, the tile notches 74 align with the fastener holes 76 in the closet flange 12, which allows the closet flange 12 to be secured to the subfloor and/or underlayment.

Referring to FIG. 3, in various embodiments, the closet flange template 40 has a height 80 that accommodates the various floor layers. For example, a bathroom floor can include a subfloor (e.g., plywood, wood slats, etc.), an underlayment (e.g., concrete board, insulation, leveling cement, radiant heating, etc.), and the top or finished surface (e.g., tile, wood, engineered wood, linoleum, etc.). The stacked floor layers may protrude above the top of the drain pipe 22. Thus, the height 80 of the closet flange template 40 ensures that the tabs 44 are positioned above the final floor layer so that the floor contractor can easily mark the floor using the template 40. The template 40 can be any suitable height, such as, for example, a half inch, three quarters of an inch, an inch or more. In addition, the exterior sidewalls of the template can include height graduations 82. The graduations 42 can be, for example, every quarter inch. As will be appreciated, any size graduations and units can be used. The graduations 82 assist the floor contractor in judging how high the finished floor 14 will be relative to the drain pipe 22 and/or the subfloor 16. Moreover, the graduations 82 also can assist in judging the depth of self-leveling mortar, which is used for various floor installations (e.g., radiant heating).

Closet flanges 12 come in various sizes and configurations. Therefore, closet flange templates 40 also can be made in corresponding configurations. Closet flange templates 40 also can be provided in universal or multi-format configurations, as appropriate, such that one closet flange template 40 can be used with multiple (e.g., two or more) types of closet flanges 12. For universal or multi-format templates, the tabs 44 and marker lines 48 can be coded (e.g., color coded) for each type of closet flange 12.

Figure 6A:
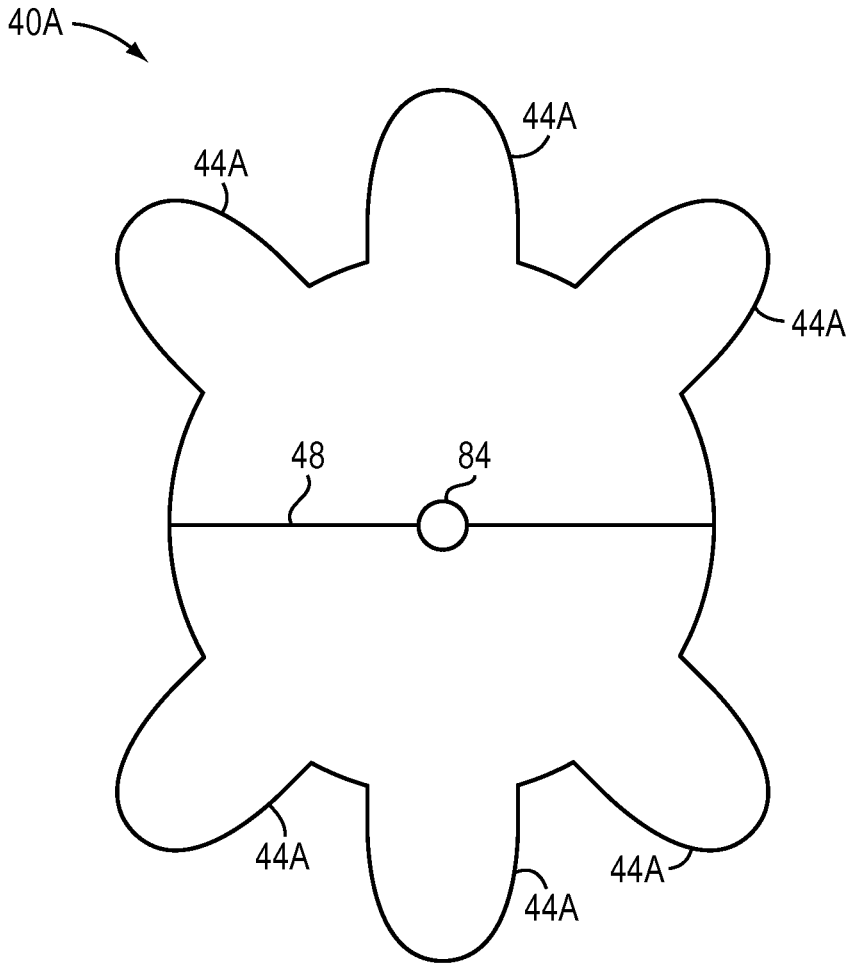
FIGS. 6A-D are diagrams of closet flange templates, in accordance with illustrative embodiments.
Figure 6B:
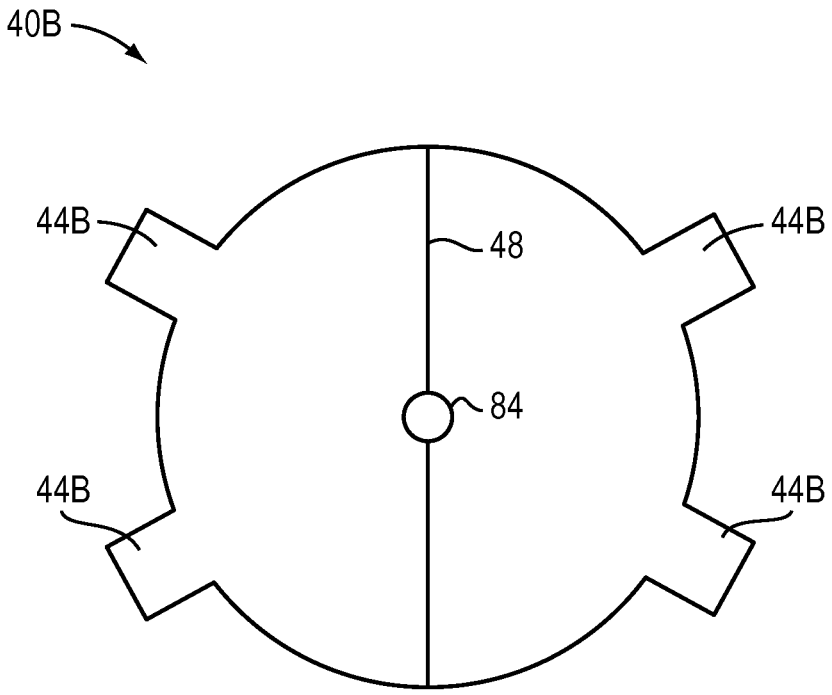
Figure 6C:
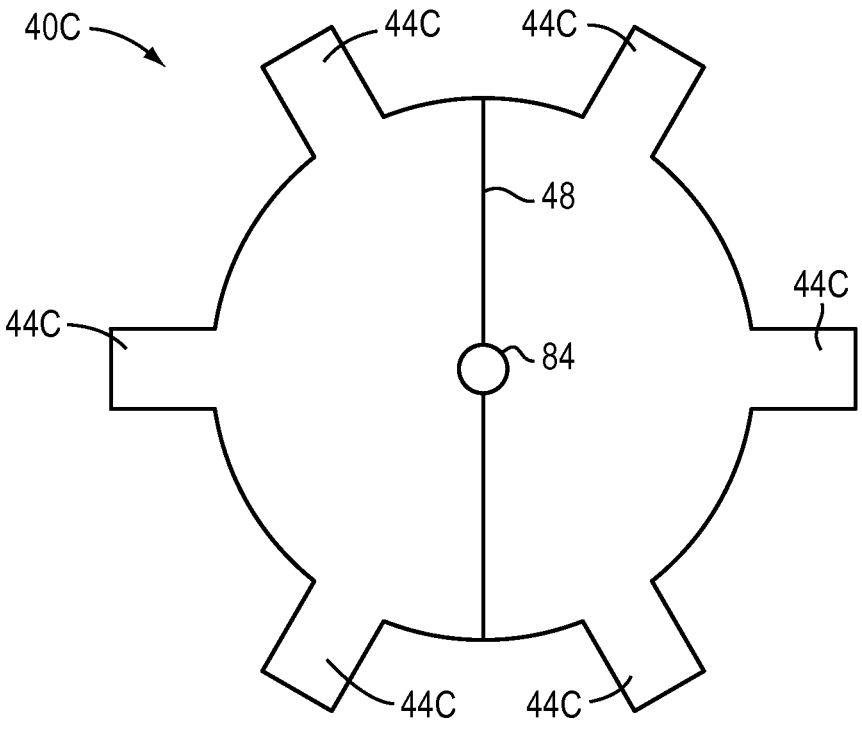
Figure 6D:
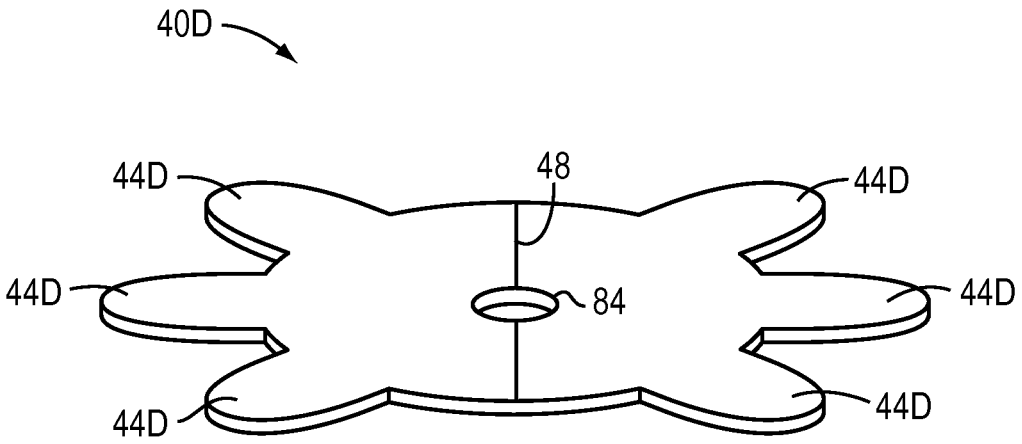

FIGS. 6A-D are diagrams of closet flange templates, in accordance with illustrative embodiments. In FIG. 6A a top plan view of a template 40A having six rounded tabs 44A and a marker line 48 that is asymmetric, relative to the location of the tabs. FIG. 6B is a top plan view of a template 40B having four square tabs 44B and a marker line 48 that is symmetrical, relative to the location of the tabs. FIG. 6C is a top plan view of a template 40C having six rectangular tabs 44C and a marker line 48 that is asymmetric, relative to the location of the tabs. In some embodiments, the template 40D can be substantially planar, as shown in FIG. 6D, rather than bowl shaped.

Modern drain pipes 22 can have an inside diameter of about 3 inches and an outside diameter of about 3½ inches. The flange 32 of the closet flange 12 can be about 7 inches in diameter, depending on the type of closet flange. As will be appreciated, these dimensions are illustrative and drain pipe dimensions and closet flange dimensions may vary depending on make and/or model. In some embodiments, the template 40 has a diameter that is substantially the same size as or slightly larger than the outside diameter of the drain pipe 22. As a result, the template tabs 44 overlie the flange 32 of the closet flange 12 and, specifically, the tabs 44 overlie the fastener holes 76 in the flange 32. The body 42 of the template 40 also serves to cover the drain pipe opening, thereby preventing tile mortar and/or self-leveling mortar from creeping into the drain pipe 22. The sidewalls of the template also can serve as a retaining wall or dam for tile mortar and/or self-leveling mortar.

Figure 7:
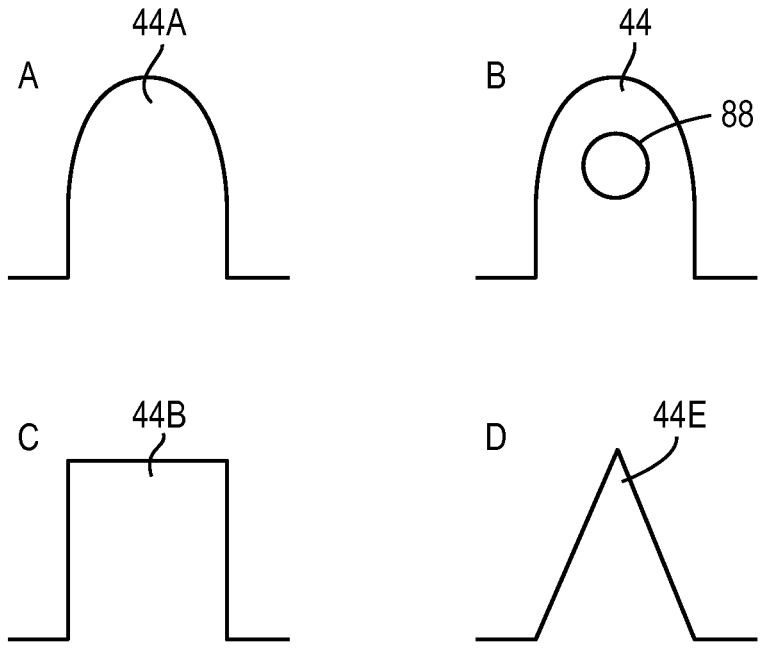
FIGS. 7A-D are schematics of closet flange template tabs, in accordance with illustrative embodiments.

The tabs 44 of the closet flange template 40 can be any suitable shape. FIGS. 7A-D are schematics of closet flange template tabs 44, in accordance with illustrative embodiments. The tabs can be substantially arched or semicircular 44A (FIG. 7A), the tabs 44 can form or include through holes 88 to aid in drilling pilot holes (FIG. 7B), the tabs can be substantially square or rectangular 44B (FIG. 7C) and/or the tabs can be substantially triangular 44E (FIG. 7D).

Referring again to FIG. 3, the tabs 44 can be connected to or integral with a free edge or rim 46 of the template body 42. The template 40 can be configured to be stackable, for ease of packaging, shipping and retail display. For example, the sidewalls that form the body 42 of the template can be substantially vertical and/or inwardly tapered such that the templates nest when stacked. In addition, the tabs 44 can be substantially parallel to or in-line with the sidewalls to facilitating stacking. The tabs 44 are later folded down when marking the floor. In some embodiments, a crease 86 at the junction between the tab 44 and the free edge 46 or body 42 of the template facilitates folding and/or repeated folding of the tabs 44.

Figure 8:
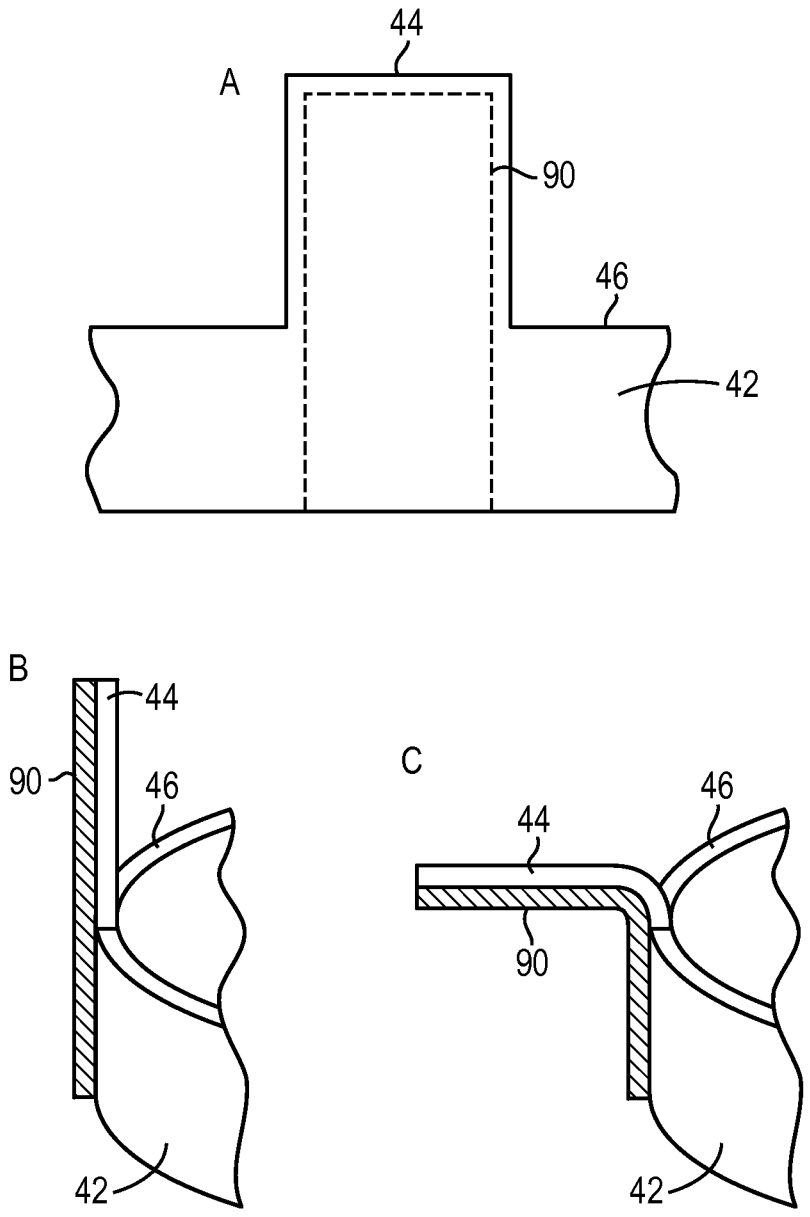
FIGS. 8A-C are schematics of reinforced closet flange template tabs, in accordance with illustrative embodiments.

FIGS. 8A-C are schematics of reinforced closet flange template tabs, in accordance with illustrative embodiments. One or more tabs 44 of the closet flange can be reinforced with a reversibly deformable material 90, such as a plastic or metal. The deformable material 90 can be added to the inside or outside (FIG. 8B) surface of the tab 44 and can extend to the body of the template 42. As shown in FIG. 8C, the deformable material 90 allows the tabs 44 to be reversibly moved from a substantially vertical configuration (e.g., for stacking) to a folded or bent configuration (e.g., for marking a floor). The deformable material 90 can be integral with the tab 44 and/or body 42 of the template 40, or the deformable material 90 can be attached using adhesive, tape, welding or fasteners (e.g., rivets, staples, etc.). As will be appreciated, templates 40 can be made of a material that itself is deformable (e.g., plastic) such that no deformable material 90 is needed to hold the tabs in a folded or bent position.

Templates 40 can be made of plastic, metal, vinyl or any other suitable material. Plastic is particularly advantageous from a cost and manufacturing perspective because plastic is inexpensive and can easily be cast or molded, for example. The template 40 can be disposable or recyclable.

The aspects, embodiments and features of the invention are to be considered illustrative in all respects and are not intended to limit the invention, the scope of which is defined only by the claims. Other embodiments, modifications and usages will be apparent to those skilled in the art without departing from the spirit and scope of the claimed invention.

Throughout the application, where an apparatus is described as having, including or comprising specific components, or where processes are described as having, including or comprising specific process steps, it is contemplated that the apparatus also can consist essentially of, or consist of, the recited components, and that the processes also can consist essentially of, or consist of, the recited process steps.

In the application, where an element or component is said to be included in and/or selected from a list of recited elements or components, it should be understood that the element or component can be any one of the recited elements or components and can be selected from a group consisting of two or more of the recited elements or components. Further, it should be understood that elements and/or features of a composition, an apparatus or a method described herein can be combined in a variety of ways without departing from the spirit and scope of the present teachings, whether explicit or implicit herein.

The use of the terms "include," "includes," "including," "have," "has" or "having" should be generally understood as open-ended and non-limiting unless specifically stated otherwise.

The use of the singular herein includes the plural (and vice versa) unless specifically stated otherwise. Moreover, the singular forms "a," "an" and "the" include plural forms unless the context clearly dictates otherwise. In addition, where the use of the term "about" is before a quantitative value, the present teachings also include the specific quantitative value itself, unless specifically stated otherwise.

It should be understood that the order of steps or order for performing certain actions is immaterial so long as the present teachings remain operable. Moreover, two or more steps or actions may be conducted simultaneously.

What is claimed is:

1. A template for closet flange installation, the template comprising:

a body having a sidewall and a bottom, the sidewall having a height and terminating in an edge; and a plurality of tabs connected to the edge, with one or more of the tabs configured to delineate the location of a fastener hole in a closet flange, wherein at least one tab is movable between a position substantially in-line with the sidewall to a position that is substantially normal to the sidewall, and wherein the closet flange includes a plurality of fastener holes for securing the closet flange to a floor and at least one slot for engaging a toilet hold-down bolt.

2. The template of claim 1, wherein each of the plurality of tabs protrudes from the edge and is substantially in-line with the sidewall.

3. The template of claim 1, wherein the body is substantially circular.

4. The template of claim 1, wherein the body is substantially bowl shaped.

5. The template of claim 1, wherein the body has a diameter approximately the same size as the outside diameter of a closet drain pipe.

6. The template of claim 1, wherein the bottom forms a hole for attaching the template to a test plug having a bolt.

7. The template of claim 1, wherein the template is integral with a test plug.

8. The template of claim 1, wherein the body comprises a marker delineating the center line of the template, whereby the template can be oriented using the marker.

9. The template of claim 1, wherein at least one tab includes a hole sized to receive a drill bit.

10. The template of claim 1, comprising a crease between at least one tab and the body, whereby the crease facilitates tab folding.

11. The template of claim 1, wherein the outside surface of the sidewall comprises height graduations.

12. The template of claim 1, wherein each of the plurality of tabs is reinforced with a deformable material.

13. The template of claim 1, wherein the body is composed of plastic.

14. A method of installing a closet flange, the closet flange having a plurality of fastener holes for securing the closet flange to a floor and at least one slot for engaging a toilet hold-down bolt, the method comprising, orienting a template, the template being placed over the open end of a closet drain pipe, the template comprising:

a body having a sidewall and a bottom, the sidewall having a height and terminating in an edge; and a plurality of tabs connected to the edge, with one or more of the tabs configured to delineate the location of a fastener hole in a closet flange;

wherein at least one tab is movable between a position substantially in-line with the sidewall to a position that is substantially normal to the sidewall, and wherein the closet flange includes a plurality of fastener holes for securing the closet flange to a floor and at least one slot for engaging a toilet hold-down bolt;

dry-fitting flooring around the closet drain pipe;

marking the flooring at the location of fastener holes in a closet flange using the tabs;

notching the flooring; and installing the flooring around the drain pipe.

15. A kit comprising:

a template comprising:

a body having a sidewall and a bottom, the sidewall having a height and terminating in an edge, and a plurality of tabs connected to the edge, with one or more of the tabs configured to delineate the location of a fastener hole in a closet flange, wherein at least one tab is movable between a position substantially in-line with the sidewall to a position that is substantially normal to the sidewall, and wherein the closet flange includes a plurality of fastener holes for securing the closet flange to a floor and at least one slot for engaging a toilet hold-down bolt; and a test plug, a closet flange or combinations thereof.

* * * * *